United States Patent [19]

Badia Iniesta

[11] Patent Number: 4,629,082

[45] Date of Patent: Dec. 16, 1986

[54] BOTTLE STOPPER

[75] Inventor: Antonio Badia Iniesta, Barcelona, Spain

[73] Assignee: Plastivit, S.A., Barcelona, Spain

[21] Appl. No.: 740,174

[22] Filed: May 31, 1985

[30] Foreign Application Priority Data

Jun. 6, 1984 [ES] Spain ..... 279.745[U]
Jun. 26, 1984 [ES] Spain ..... 280.195[U]

[51] Int. Cl.[4] ..... B65D 41/34
[52] U.S. Cl. ..... 215/252; 215/253
[58] Field of Search ..... 215/252, 253

[56] References Cited

U.S. PATENT DOCUMENTS 3,850,328 11/1974 Guala ..... 215/252
4,550,845 11/1985 Guala ..... 215/252

FOREIGN PATENT DOCUMENTS 2334750 1/1975 Fed. Rep. of Germany ..... 215/252

*Primary Examiner*—Donald F. Norton
*Attorney, Agent, or Firm*—Joan H. Pauly

[57] ABSTRACT

A bottle stopper, having a first portion adapted to fit a neck and attached over a weakened region to a tubular portion having means facilitating the retention of the tubular portion on the neck. The first portion comprises cylindrical and coaxial an outer wall and an inner wall, the inner wall defining an upper opening, and having a fin as a first sealing means. A cap portion surrounds said first portion and both are provided with mating protuberances for mutual engagement. The cap portion is provided, with an annular wall fitting inside the wall being adapted to retain a second stopper means, preferably of cork. The tubular portion is provided with means to prevent rotation thereof.

10 Claims, 9 Drawing Figures

BOTTLE STOPPER

BACKGROUND OF THE INVENTION

The invention relates to a bottle stopper, of the type having a first portion adapted to fit the end portion of a bottle neck and attached over a weakened annular region to a tubular security portion to be retained on the neck, the tubular portion being provided on the inside thereof with retaining means adapted to engage at least one protuberance on the bottle neck for such retaining purposes.

When the first portion of the stoppers of the above type is removed, the stopper tears along the annular weakened region, since the tubular security portion is retained on the neck and cannot rise with the first portion. Nevertheless, at the start of removal, the tubular security portion rotates together with the first portion, thus causing a progressive elongation of the plastics material in the tearing portion, forming threads which finally remain attached to the security portion, spoiling its appearance and, therefore that of the bottle itself.

It should also be borne in mind that a majority of wine producers consider it a drawback to stopper bottles with plastic stoppers and prefer the material which may contact the wine to be cork.

Therefore, the problem arises of overcoming the above drawbacks concerning the separation of the security portion and also with respect to the possible use of cork, without this latter meaning having to waive the benefits derived from the use of plastics material.

SUMMARY OF THE INVENTION

To overcome this situation, a stopper of the above described type has been devised, wherein the first portion and the tubular security portion form an integral body of polyolefinic plastics material, the first portion comprises an inner wall and an outer wall which are generally cylindrical and coaxial, the inner wall being shorter than the outer wall and defining an upper opening, there being provided protuberances in the outer lateral surface of the outer wall and the inner wall having an inwardly directed elbow portion, with a resilient fin for engagement as a first sealing means with the end surface of the neck; and wherein the first portion is adapted to be surrounded by a rigid plastics material cap portion, comprising an end wall and a cylindrical skirt provided on the inside thereof with protuberances adapted to engage the protuberances of the outer wall, with an annular wall having an outside diameter generally equal to the inside diameter of the inner wall extending from the end wall, the annular wall being adapted to retain a second stopper means.

BRIEF DESCRIPTION OF THE DRAWINGS

Hereinafter there are described preferred embodiments, with reference to the accompanying drawings, in which.

DESCRIPTION OF THE PREFERRED EMBODIMENTS

Figure 1:
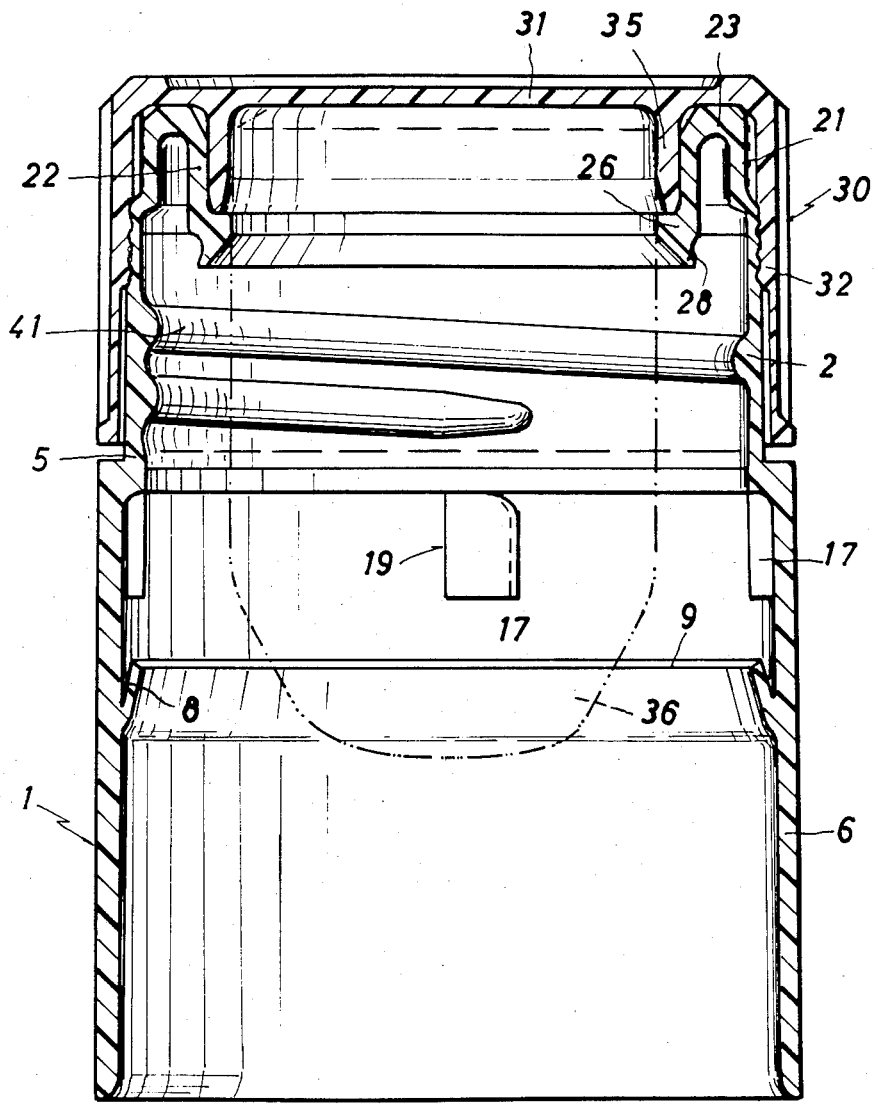
FIG. 1 is an axial cross sectional view of the stopper, illustrating the cap portion and a cork portion, the latter in phantom line.

The stopper 1 comprises a first portion 2, adapted to fit the end portion of the neck 3 of a bottle 4. The portion 2 is connected over a weakened annular region 5 to a tubular security portion 6. The region 5 may be weakened by a series of discontinuous cuts 7 or similar system. The portion 2 and tubular portion 6 are an integral body of polyolefinic plastics material, such as polythene or polypropylene, having the desired resilient properties.

The tubular portion 6 is to be retained on the neck 3 and to this end it is provided on the inside thereof with retaining means. The retaining means are preferably formed by a generally annular resilient fin 8 extending inwardly from the tubular portion 6 towards the first stopper portion 2, namely, the free edge 9 thereof is generally facing the first portion.

In the stopper moulding process, this fin is disposed inclined in the opposite direction and the direction of slope is reversed in a subsequent operation. The fin 8 is to engage a protuberance 10 which may be annular or interrupted, around the neck 3 of the bottle 4.

The first portion 2 comprises an outer wall 21 and an inner wall 22, both being generally cylindrical and coaxial, connected by an end portion 23. The outer wall 21 is provided in the outer lateral surface thereof with protuberances, preferably formed by areas having an axial knurling and annular ribs 24, to engage with mating means on the cap portion to be described presently.

The inner wall 22 is shorter than the outer wall and defines an upper opening 40 in the first portion 2. At one end of the wall 22 there is an inwardly directed elbow portion 26, forming a step 27. From the lowermost portion of the elbow portion 26 there extends a resilient fin 28 for engagement with the end surface of the neck, to form a first sealing means.

The first portion 2 has a smaller diameter than the tubular security portion 6 and furthermore, as said above, is provided with annular ribs 24 and axial knurling 25. The stopper is covered with a cap portion 30 having an end wall 31 and a cylindrical skirt 32 on the inside of which there ar protuberances formed preferably by annular ribs 33 and axial knurling 34, to mate with the like means on the stopper, to connect the cap portion to the stopper.

The cap portion allows for combinations of different colours and materials, at the same time as it facilitates the manufacturing process by making mould stripping of the stopper possible.

The cap portion is made from rigid plastics material such as polystyrene or acrylonitrile butadiene styrene (ABS) which has the property of easily accepting a second stopper means, particularly cork, with the aid of adhesives.

From the end wall 31 of the cap portion there extends an annular wall 35 having an outside diameter generally equal to the inside diameter of the inner wall 22, so that when the cap portion is attached to the portion 2, the annular wall 35 snugly engages the inner wall 22. The cylindrical space defined by the wall 35 and the end wall 31 is suitable for housing a cylindrical and/or frustoconical piece of cork, i.e. a conventional cork stopper 36 (shown in phantom in FIG. 1) for engagement with the inner surface of the bottle neck, such as to form the second stopper means mentioned above.

Figure 2:
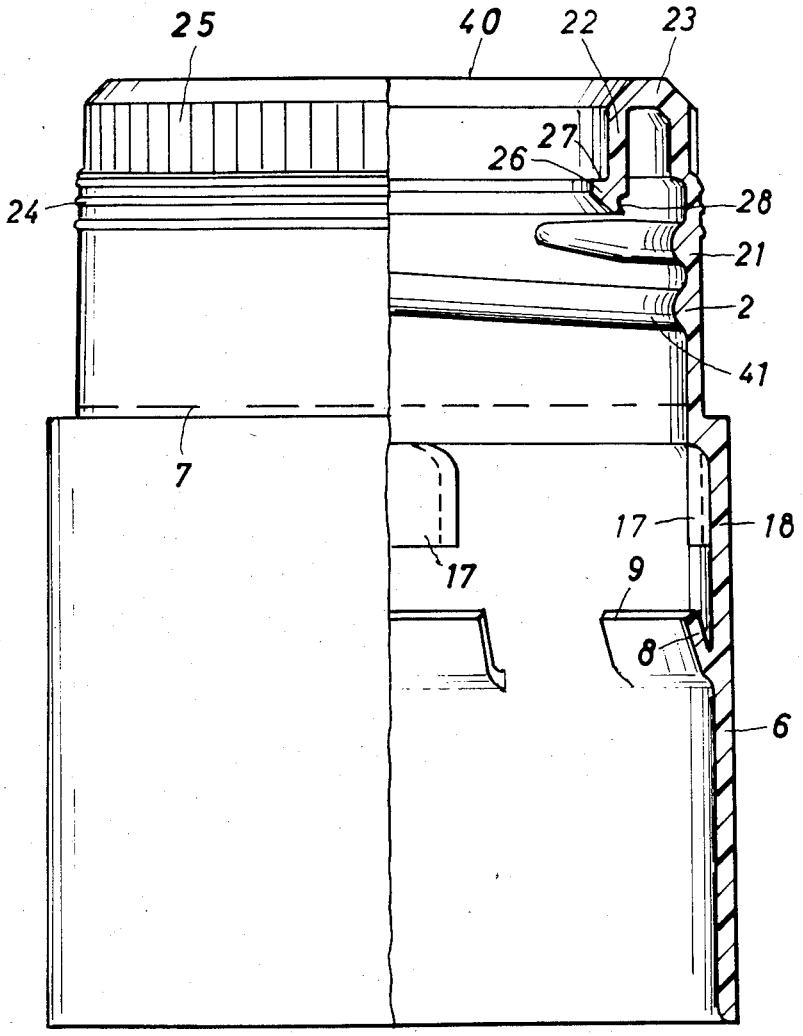
FIG. 2 is an elevation view of the stopper, with the cap portion removed and one half shown in an axial plane.
Figure 3:
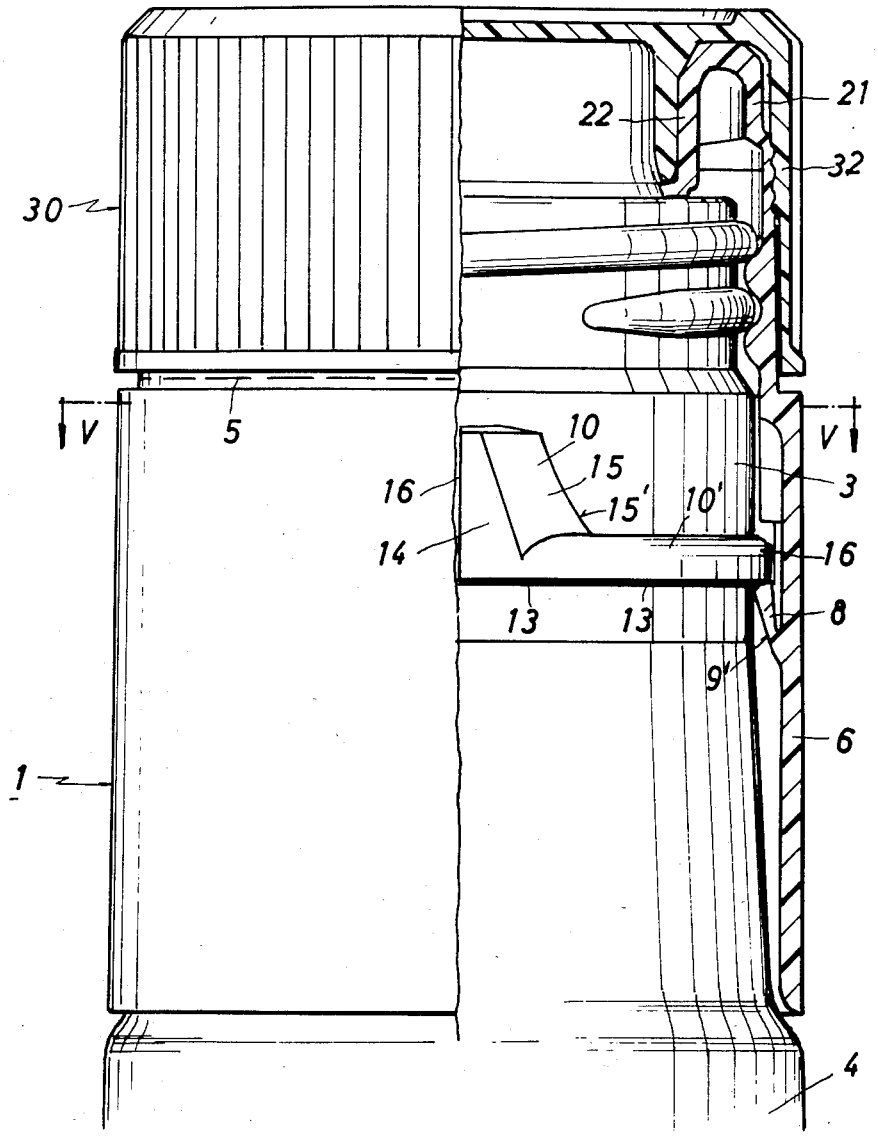
FIG. 3 is a similar view and section to the previous figure, showing the cap portion and the stopper applied to a bottle neck.
Figure 4:
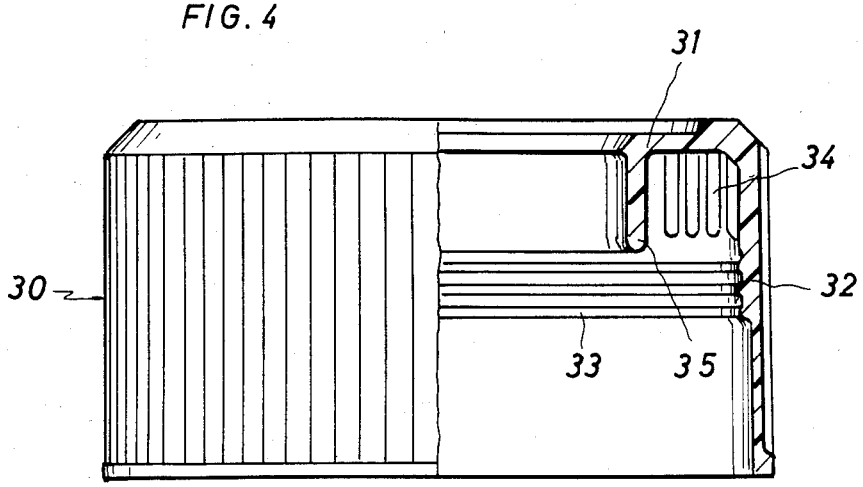
FIG. 4 is a similar view and section to the previous figures, but showing the cap portion.
Figure 5:
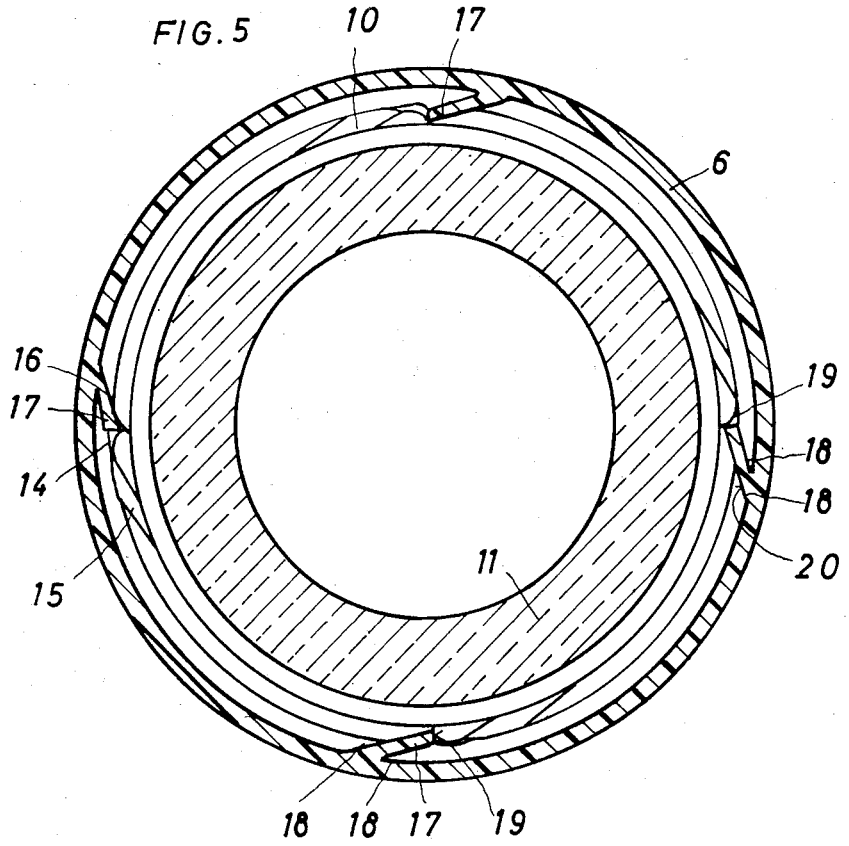
FIG. 5 is a cross sectional view along the line V—V of FIG. 3.

In the embodiment illustrated in FIGS. 3 and 5, the protuberance 10 is provided with a generally transverse surface 13 and end surfaces 14 and 15 and a leteral surface 16 generally contained in a diametral plane; further mention will be made of the last named hereinafter. The surfaces 14 and 15 slope gently away from the neck 3 in an upward direction, as shown in FIG. 3. This slope allows the surface 9' of the fin to slide easily over the surfaces 14 and 15 and pass beyond the surface 13 when sealing the bottle. Furthermore, the surface 15 progressively diverges from the axis of the neck in a transverse direction from the edge 15'. There is preferably provided a rib 10' between two consecutive protuberances 10, whereby the free edge 9 of the fin 8 is faced in any position with the surface 13. The fin 8 may be gapped, as shown in FIG. 2.

When the fin 8 moves beyond the surface 13, this surface 13 and the fin edge 9 are facing each other, whereby the tubular portion 6 is retained on the bottle neck in a much more efficient way than with the usual conventional mating protuberances.

The outer wall 21 of the first portion, in the embodiment illustrated in FIGS. 1 to 5, is provided with an inner thread 41 allowing it to be screwes on the bottle neck. In this embodiment, the tubular security portion is also provided on the inside thereof with a plurality of resilient tabs 17 diverging slightly from the tubular portion and having root portions or portions 18 connecting them to the tubular portion disposed generally on generatrix portions of the tubular portion. What is important is that the free edge 19 of each tab opposed to the root end thereof should be orientated generally axially relative to the stopper, i.e. generally parallelly to the ideal axis of the stopper.

The tabs 17 may fold down against the surface of the tubular portion. In the bottle sealing operation, the whole of the stopper rotates around the neck 3 in a clockwise direction, whereby when the tabs reach the level of protuberance 10 they slide over the surface 15 of the latter since the surface 15 and the surface 20 of the tabs are matingly sloped. Nevertheless, when it is attempted to rotate the stopper in the opposite direction, the protuberances 10 through the surfaces 16 thereof lock with the fins 17 by way of the free edge 19 thereof, thereby making it impossible for the tubular portion to rotate when unscrewing the stopper 1.

The flexible tabs afford obvious advantages over solid saw-toothed arrangements: firstly, since the flexible tabs may lay flat against the tubular portion, they offer less resistence on screwing up (sealing operation) than the solid arrangements; secondly the tabs lock better than the solid arrangements which may even jump over the protuberance 10, because of breakage of the tips of the solid arrangement. Furthermore, the presence of such solid arrangements unavoidably affects the corresponding outer surface of the security portion, spoiling its appearance by contraction pits of the plastics material.

It has already been remarked that the sealing operation, performed by screwing the cap on the bottle, affords no difficulties, since neither the interaction between the annular fin and surface 13 nor the further engagement between the tab 17 and surface 16 of the protuberance 10 represent any obstacle to the downward rotatory movement.

When screwing the stopper off, the first portion 2 starts to rotate in a counterclockwise direction and, therefore, the screwthread causes the portion 2 to move up the neck 3.

Nevertheless, this upward movement may not be followed by the tubular security portion 6 since the engagement of the fin 8 with the surface 13 prevents it. This alone would be sufficient to cause the region 5, weakened by the cuts 7, to tear and break away from the first portion 2, but this tear is not clean, due to the fact that the security portion follows the rotation of the portion 2, causing the formation of plastics threads which remain attached to the security portion and spoil the appearance thereof and, therefore, of the bottle itself.

But, furthermore, according to the invention, the tubular portion 6 may not follow the rotation of the part 2 either, in view of the locking action described between the tabs 17 and the surface 16 of protuberances 10. Therefore, since portion 6 does not follow the rotation of portion 2, the tear in the region 5 occurs without one portion pulling the other and forming threads and, therefore, is a clean tear.

Figure 6:
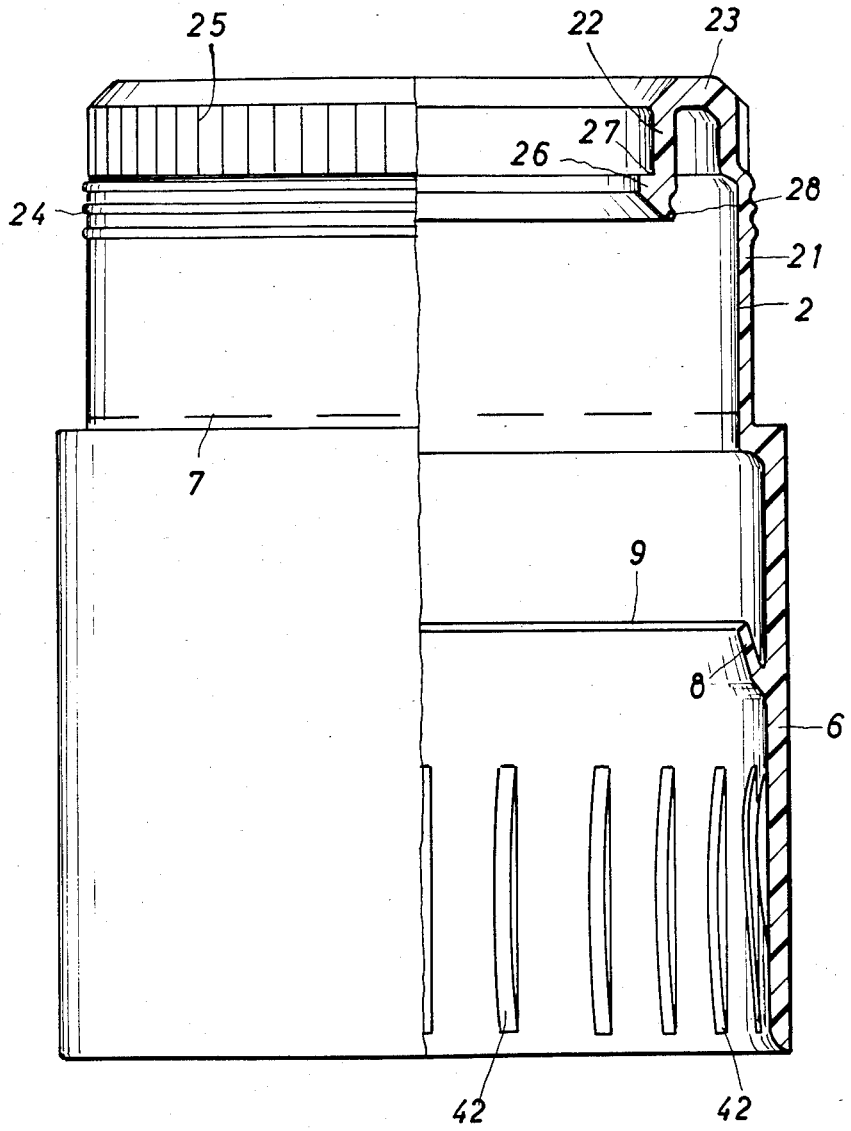
FIG. 6 is a similar view to FIG. 2, of an alternative embodiment.
Figure 7:
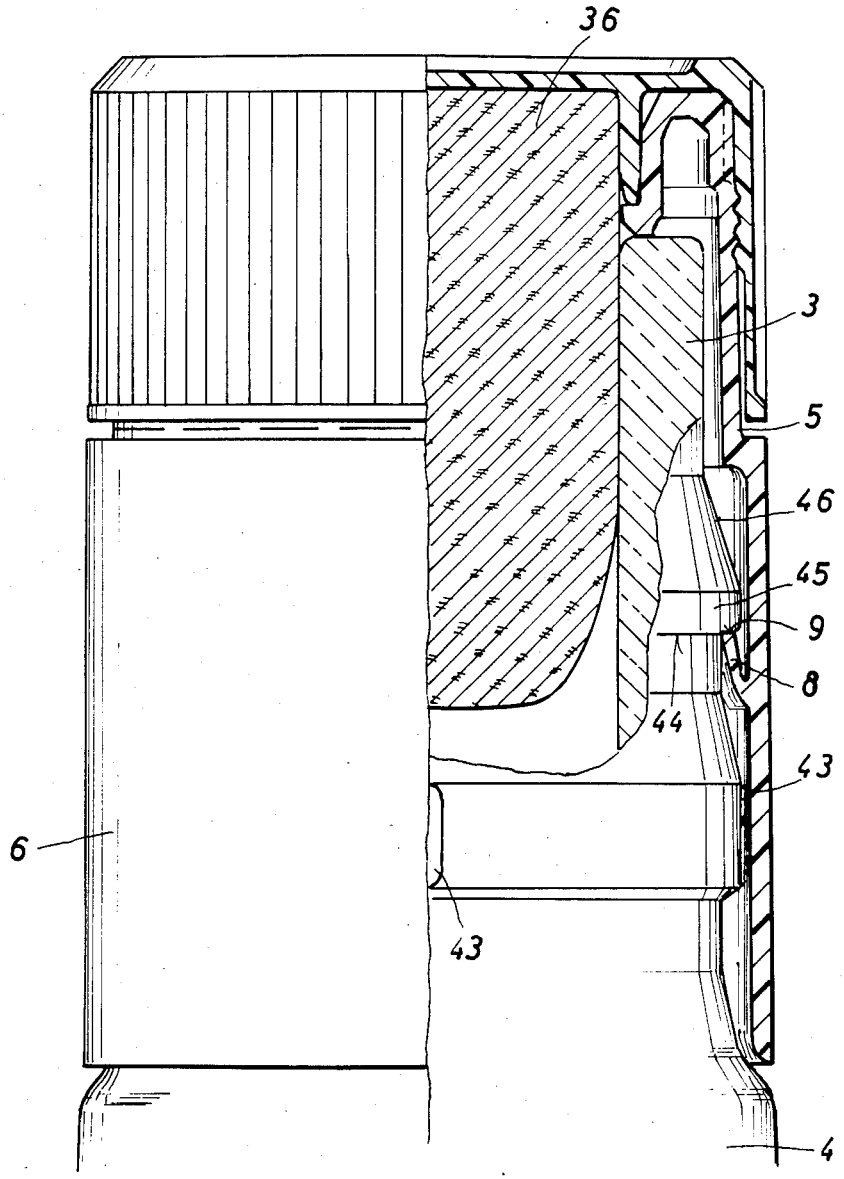
FIG. 7 is an elevation view of the stopper applied to a bottle neck, one of the halves being in section along an axial plane and the bottle neck being partly in section, the stopper corresponding to the embodiment shown in FIG. 6.
Figure 9:
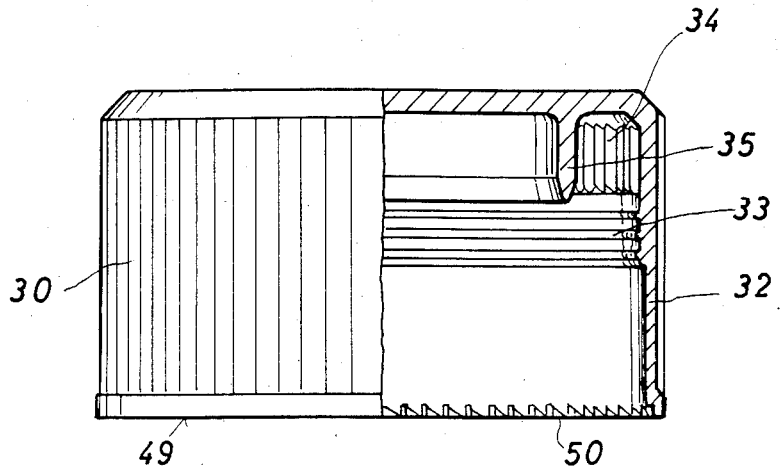
FIG. 9 is a similar view to FIG. 8, of the third embodiment, the edge of the cap portion being provided with a plurality of notches mating with the teeth.
Figure 8:
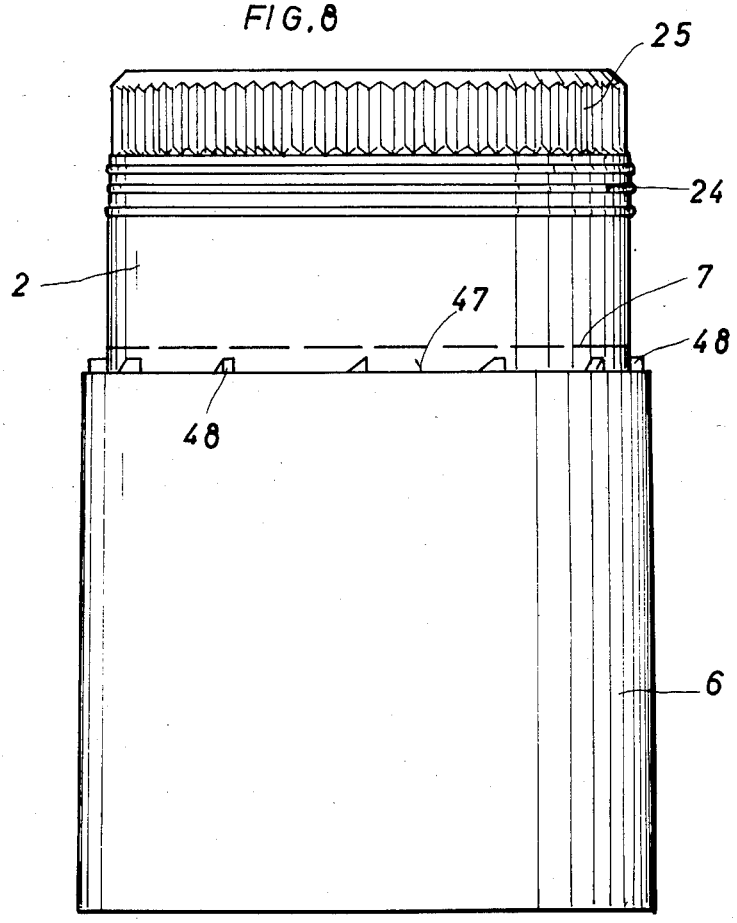
FIG. 8 is an elevation view of a third ambodiment of the stopper of the invention, without the cap portion and having a plurality of teeth in the proximity of the weakened region.

In the embodiment according to FIGS. 6 and 7, the outer wall 21 of the first portion 2 is generally smooth on the inner surface thereof and the tubular portion 6 is further provided on the inside thereof with a plurality of inwardly extending axial protuberances 42. These inwardly extending axial protuberances 42 are adapted to cooperate with further axial protuberances 43 on the bottle neck 3, such that with one protuberance 43 in the space between two protuberances 42, the relative rotation of the stopper to the bottle is inhibited in both directions.

FIG. 7 illustrates the protuberances 43 as being spaced apart in 90°, although there may be more in number, for example, as many as there are protuberances 42 on the stopper. The thickness of the protuberances 43 must correspond to the distance dimension between two consecutive protuberances 42.

Preferably the rotation-inhibiting axial protuberance 42 are located further from the first portion 2 of the stopper 1 than the resilient annular fin 8, so as to ensure their self-orientation before the fin moves beyond the surface 44 of the neck, thereby preventing the protuberances 42 from riding up on the protuberances 43 as a result of the random orientation when sealing the bottle.

In this embodiment, neck 3 is provided with protuberances 45. Each of these protuberances 45 has a frustoconical surface 46 allowing the fin 8 to slide easily thereover, flattening itself against the inner surface of the tubular portion 6. The protuberance 10 is provided on the lower side thereof with a surface 44 generally transversal to the axis of the neck. When sealing the bottle, as stated hereinbefore, the fin slides without difficulty over the surface 46 to move beyond surface 44.

When the fin 8 has moved beyond the surface 44, the latter and the fin edge 9 are opposed to each other, whereby the tubular portion 6 is retained on the bottle neck in a much more effective way than with the usual conventional mating protuberances.

In this embodiment, the bottle is sealed by a vertical pressure and, as stated, offers no difficulties.

When the stopper is first removed from the bottle, the first portion 2 starts to move upwards and this upward movement may not be followed by the tubular security portion, since the engagement of the fin 8 with the surface 44 prevents it. This alone would be sufficient for the region 5, weakened by the cuts 7, to tear away from the first portion 2, but this tear would not be clean if the tubular security portion could rotate relative to the stopper, forming plastics threads which remain attached to the security portion and spoil the appearance thereof and, therefore, of the bottle itself.

But furthermore, the tubular portion 6 cannot follow the rotation of portion 2 either, because of the aforesaid locking action between the protuberances 42 and protuberances 43 on the bottle neck. Therefore, since the portion 6 does not rotate with the portion 2, region 5 tears without one portion pulling the other and forming threads, whereby the tear is clean.

Therefore, with the above described stopper it is possible to satisfy the desires of the wine processors insofar as it is preferably for the wine to make contact with cork and not with plastic; and furthermore to obtain a fully guaranteed security stopper, the security portion being broken away effectively, without forming undesired plastics threads.

In both embodiments described, the stopper encapsulating operation, under certain circumstances, may cause stresses tending to cause tearing of the discontinuous cut region 5. To avoid this, the tubular security portion 6 is provided, in the step 47 thereof close to the weakened region, with a plurality of equally spaced teeth 48. The cap portion 30 is also provided with a cylindrical skirt 32 of sufficient length for its edge 49 to reach the step 47. The edge 49 is provided with notches 50, also equally spaced apart and in a number being a multiple of the teeth 48, thereby assuring that when the cap portion 30 is placed over the portion 2, all the teeth 48 engage some of the notches 50. The teeth are sawtooth shaped and the notches have a mating shape.

When the cap portion 30 is fitted and when the stopper 1 is screwed on the bottle neck, the rotatory movement is transmitted on the portion 2 by the mutual action between the knurlings 25 and 34 and ribs 24 and 33 and to the tubular portion 6 by interaction of the teeth 48 and notches 50, completely avoiding any possibility of harmful stress for the weakened area.

The cap portion may be closed at the end wall thereof by various systems such as cork discs, elastomeric materials, plastisols or others.

What is claimed is:

1. A bottle stopper, of the type having a first portion adapted to fit the end portion of a bottle neck and attached over a weakened annular region to a tubular security portion to be retained on the neck, said tubular portion being provided on the inside thereof with retaining means adapted to engage at least one protuberance on the bottle neck to retain said tubular portion on the neck, wherein said first portion and said tubular security portion form an integral body of polyolefinic plastics material, said first portion comprises an inner wall and an outer wall which are generally cylindrical and coaxial, the inner wall being shorter than the outer wall and defining an upper opening, there being provided protuberances in the outer lateral surface of the outer wall and the inner wall having an inwardly directed elbow portion, with a resilient fin for engagement as a first sealing means with the end surface of the neck; and wherein said first portion is surrounded by a plastics material cap portion, comprising an end wall and a cylindrical skirt provided on the inside thereof with protuberances adapted to engage the protuberances of the outer wall, with an annular wall having an outside diameter generally equal to the inside diameter of said inner wall extending from said end wall.

2. The stopper of claim 1, comprising substantially cylindrical second stopper means retained by said annular wall.

3. The stopper of claim 2, wherein said second stopper means comprises a piece of cork.

4. The stopper of claim 1, wherein the outer wall of said first portion is provided with an inner thread allowing it to be screwed on the neck and wherein there is a plurality of resilient tabs each having a root portion thereof inside said tubular portion, diverging slightly from said tubular portion and a free end opposite said root portion extending generally axially to the stopper.

5. The stopper of claim 4, wherein said tubular portion retaining means comprises a generally annular resilient fin extending obliquely from said tubular portion towards said first stopper portion.

6. The stopper of claim 5, wherein said resilient fin is discontinuous.

7. The stopper of claim 1, wherein the outer wall of said first portion is generally smooth on the inner surface thereof and wherein said tubular portion is provided on the inside thereof with a plurality of axially extending protuberances adapted to interspace further external protuberances on the bottle neck, thereby preventing said tubular portion from rotating relative to the bottle.

8. The stopper of claim 7, wherein said tubular portion retaining means comprises a generally annular resilient fin extending obliquely from said tubular portion towards said first stopper portion.

9. The stopper of claim 8, wherein said resilient fin is discontinuous.

10. The stopper of claim 1, wherein the tubular portion is provided in the proximity of the annular weakened region with a plurality of teeth which engage notches formed in the free edge of the cap portion skirt, such that any rotation of the cap portion is transmitted through such teeth and notches to the tubular portion.

* * * * *